US008336273B2

(12) United States Patent
Enns

(10) Patent No.: US 8,336,273 B2
(45) Date of Patent: Dec. 25, 2012

(54) RAINSCREEN ATTACHMENT SYSTEM

(75) Inventor: Douglas Brent Enns, Stillwater, OK (US)

(73) Assignee: The Board of Regents for Oklahoma State University, Stillwater, OK (US)

( * ) Notice: Subject to any disclaimer, the term of this patent is extended or adjusted under 35 U.S.C. 154(b) by 267 days.

(21) Appl. No.: 12/749,851

(22) Filed: Mar. 30, 2010

(65) Prior Publication Data

US 2010/0251647 A1 Oct. 7, 2010

Related U.S. Application Data

(60) Provisional application No. 61/167,457, filed on Apr. 7, 2009.

(51) Int. Cl.
*E04B 2/00* (2006.01)

(52) U.S. Cl. ..... 52/588.1; 52/302.1; 52/489.2; 52/796.1

(58) Field of Classification Search ..... 52/302.1, 52/474, 478, 489.1, 489.2, 543, 544, 545, 52/550, 552, 553, 556, 235, 511, 506.01
See application file for complete search history.

(56) References Cited

U.S. PATENT DOCUMENTS

| | | | | | |
|---|---|---|---|---|---|
| 2,038,966 | A * | 4/1936 | Stewart et al. | 52/522 |
| 2,395,726 | A * | 2/1946 | Del Tufo | 52/509 |
| 2,814,999 | A * | 12/1957 | Reeves | 52/478 |
| 2,877,877 | A * | 3/1959 | Davis, Jr. | 52/478 |
| 3,438,168 | A * | 4/1969 | Tischuk | 52/478 |
| 3,520,099 | A * | 7/1970 | Mattes | 52/531 |
| 3,898,780 | A * | 8/1975 | Beer | 52/302.3 |
| 4,019,296 | A * | 4/1977 | Jochmann | 52/268 |
| 4,292,781 | A * | 10/1981 | Chalmers et al. | 52/547 |
| 4,685,263 | A * | 8/1987 | Ting | 52/235 |
| 4,700,520 | A * | 10/1987 | Ting | 52/478 |
| 4,840,004 | A * | 6/1989 | Ting | 52/235 |
| 4,866,896 | A * | 9/1989 | Shreiner et al. | 52/235 |
| 4,924,647 | A * | 5/1990 | Drucker | 52/235 |
| 4,936,078 | A * | 6/1990 | Porter | 52/592.1 |
| 5,154,029 | A * | 10/1992 | Sturgeon | 52/235 |
| 5,191,745 | A * | 3/1993 | Story | 52/506.05 |
| 5,363,623 | A * | 11/1994 | King | 52/520 |
| 5,452,552 | A * | 9/1995 | Ting | 52/235 |
| 5,544,461 | A * | 8/1996 | Sommerstein | 52/235 |
| 5,575,127 | A * | 11/1996 | O'Neal | 52/520 |
| 5,598,671 | A * | 2/1997 | Ting | 52/235 |
| 6,035,598 | A * | 3/2000 | Sukolics et al. | 52/506.08 |
| 6,044,609 | A * | 4/2000 | Kim | 52/551 |
| 6,367,220 | B1 * | 4/2002 | Krause et al. | 52/512 |

(Continued)

*Primary Examiner* — William Gilbert
*Assistant Examiner* — James Ference
(74) *Attorney, Agent, or Firm* — Fellers, Snider, Blankenship, Bailey & Tippens, P.C.

(57) ABSTRACT

A wall mounted panel system wherein panels are permitted three directions of expansion and contraction since each of panel is affixed to the wall at a single point. For example, the system includes a first and second panel adjacent to one another. An upper bracket and a lower bracket are affixed to the back of each panel, wherein the upper brackets are affixed to the wall and wherein the lower bracket of the first panel is movably engaged with the upper bracket of the second panel. The panels do not communicate with any sealing members, thereby allowing for air to flow freely behind the panels for providing a means of removing moisture from behind the panels. A brace member in communication with the interior surface of each panel has an upper end affixed to the upper bracket and a lower end affixed to the lower bracket.

7 Claims, 7 Drawing Sheets

U.S. PATENT DOCUMENTS 6,393,792 B1 * 5/2002 Mowery et al. ..... 52/520
6,425,218 B1 * 7/2002 Doyon et al. ..... 52/235
6,427,408 B1 * 8/2002 Krieger ..... 52/489.1
6,430,885 B1 * 8/2002 Ito ..... 52/483.1
6,484,465 B2 * 11/2002 Higgins ..... 52/474
6,505,448 B2 * 1/2003 Ito ..... 52/474
6,619,004 B2 * 9/2003 Loper ..... 52/302.1
6,631,589 B1 * 10/2003 Friedman et al. ..... 52/30
6,694,694 B2 * 2/2004 Zeeff ..... 52/506.01
6,973,756 B2 * 12/2005 Hatzinikolas ..... 52/235
7,043,884 B2 * 5/2006 Moreno ..... 52/235
7,134,247 B2 * 11/2006 Ting ..... 52/235
7,698,864 B2 * 4/2010 Justice et al. ..... 52/519
2002/0029535 A1 * 3/2002 Loper ..... 52/302.1
2002/0032999 A1 * 3/2002 Ito ..... 52/474
2002/0184845 A1 * 12/2002 Horowitz ..... 52/489.2
2003/0056457 A1 * 3/2003 Zeeff ..... 52/520
2003/0070368 A1 * 4/2003 Shingleton ..... 52/173.3
2005/0072060 A1 * 4/2005 Moncho et al. ..... 52/79.1
2006/0026921 A1 * 2/2006 Krause ..... 52/550
2007/0022682 A1 * 2/2007 Morgenegg et al. ..... 52/235
2008/0256882 A1 * 10/2008 Kidd ..... 52/235

* cited by examiner

RAINSCREEN ATTACHMENT SYSTEM

CROSS REFERENCE TO RELATED APPLICATIONS

This application claims the priority of U.S. Provisional Patent Application No. 61/167,457 entitled "RAINSCREEN ATTACHMENT SYSTEM," filed Apr. 7, 2009, the contents of which are hereby incorporated by reference.

STATEMENT REGARDING FEDERALLY SPONSORED RESEARCH OR DEVELOPMENT

This invention was made with government support under grant number SBAHQ-05-I-0061 awarded by the U.S. Small Business Administration. The government has certain rights in the invention.

FIELD OF THE INVENTION

A novel method of attaching building façade panels to the exterior of buildings to create a drained/back-ventilated rainscreen. More particularly, the invention consists of a series of brackets and panel configurations that allow the panels to be attached easily, allow airflow behind the panels, allow for the thermal expansion and contraction of the panels, allow for guttering of water, and reduce the labor and material requirements when compared to existing systems.

BACKGROUND OF THE INVENTION

Current aluminum composite material (ACM) panel attachment methods are labor intensive and require a large amount of aluminum extrusions. This makes the overall system costly when compared to other building siding materials. Also, most current systems are designed to be water-tight by means of rubber seals and/or caulking. A water-tight system is difficult to achieve in practice and does not allow for the removal of moisture trapped in the interior of the panels.

ACM panels are typically spaced between ⅜ and ¾ inches apart for aesthetics and to allow for the thermal expansion of the panels. Existing ACM systems use caulking, aluminum extrusions, or additional pieces of ACM (referred to as reveal strips) to fill in the joint gap between the panels.

SUMMARY OF THE INVENTION

The invention is a method and apparatus for attaching panels, e.g., aluminum composite material (ACM) panels, to the exterior of buildings to create a drained/back-ventilated rainscreen. The system is based on the Drained/Back Ventilated (D/B-V) Rainscreen principle. The system will allow air to flow freely behind the panels, thereby providing a means of removing moisture from the interior of the panels. The system will allow some water penetration, but will control this water using a guttering network. The system consists of a series of interlocking brackets and panel configurations that allow the panels to be attached easily, allow airflow behind the panels, allow for the thermal expansion and contraction of the panels, allow for guttering of water, and reduce the labor and material requirements when compared to existing systems.

By creating a novel panel configuration that allows the panels to overlap, the Improved Rainscreen Attachment System (IRAS) eliminates the need to fill the gap between panels with additional components. In the system of the invention, the reveal strip is integrated into the right side of a left panel. The reveal strip is formed from the ACM and therefore requires no additional painting or means of fastening. Standard hat furring channel, a very common building material, is located behind the joint gap and serves as an inexpensive means of guttering in the vertical direction any water that penetrates the vertical joint as well as water that has been channeled there by the horizontal joint guttering system.

In the improved rainscreen attachment system of the invention, guttering in the horizontal direction is achieved by a channel that is formed out of panel material and is an integral part of the panel. Again, because the channel is integrated into the panel, the channel requires no additional painting or means of fastening. The horizontal joint prevents rainwater from getting behind the panels yet allows for air to flow freely in behind the panels. This air flow provides a means of removing moisture from the inside of the panels.

The joints also allow the bottom of each panel to float up or down or from side to side to compensate for the thermal expansion and contraction of the panels. Without this feature the panel edges would be fixed and the panels would tend to bow (referred to as "pillowing") as the panels thermally expand. In the current system, only the top of each panel is fixed, while the other three sides are allowed to float. If deemed necessary, the top of each panel could also be designed to have some limited amount of float. This would be accomplished by simply slotting the mounting holes in the top brackets and using shouldered bolts to attach the brackets to the external sheathing.

Upper brackets provide a rigid framework for the gutter section of the ACM. The upper brackets also serve as the means of attaching the panel to the wall and create a gap, e.g., 1 inch, between the panel and the wall to allow for adequate airflow between the wall and the panel.

Bottom brackets are provided of varying lengths depending on whether a long or short joint gap is desired. The bottom bracket allows the bottom of the panel to hook onto the top of the previously placed panel. The bottom bracket may be only 3 inches wide, a continuous extrusion nearly equal in length to the width of the panel.

DETAILED DESCRIPTION OF THE PREFERRED EMBODIMENTS

Figure 1:
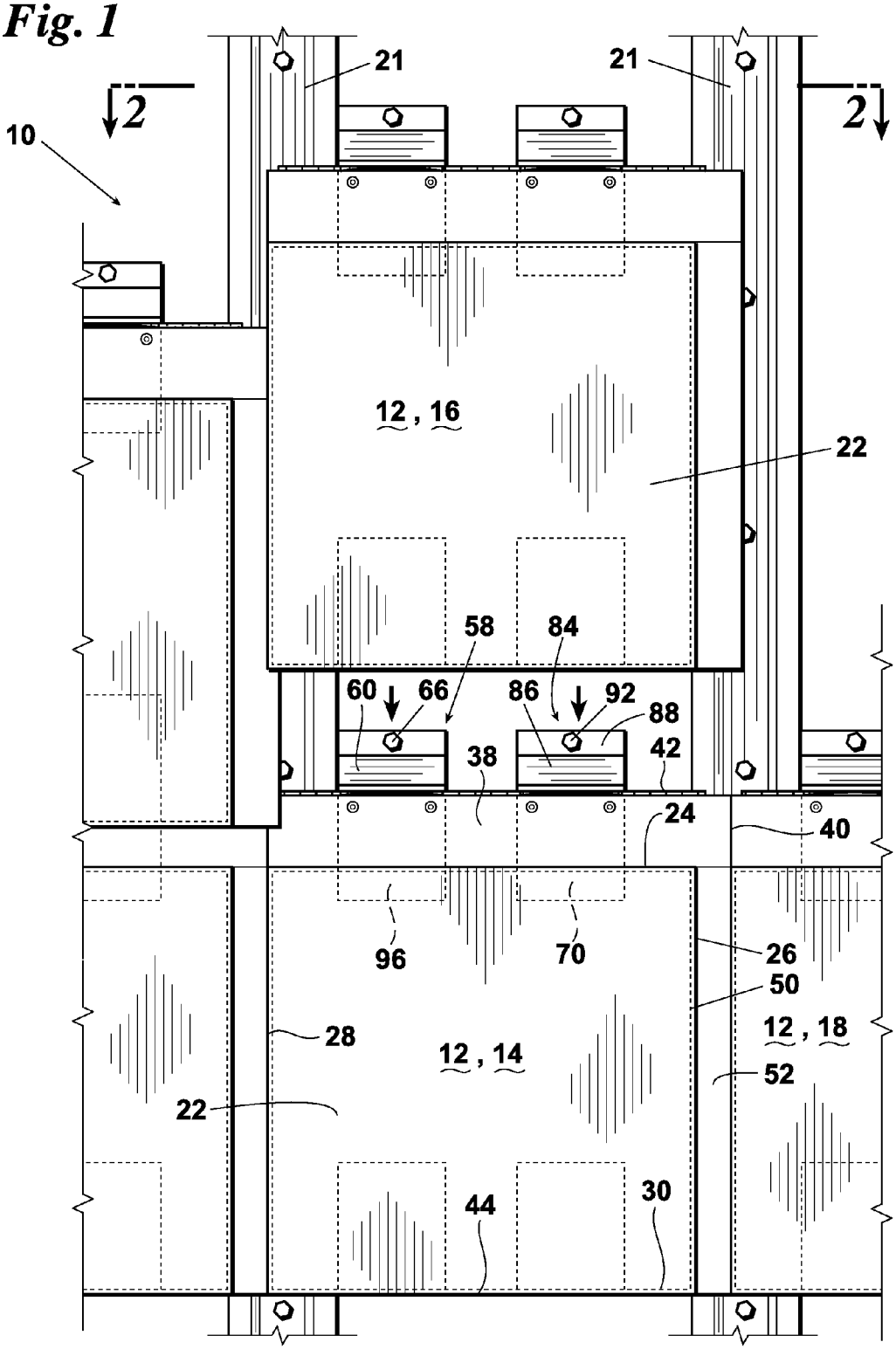
FIG. 1 is an elevation view of the panel system of the invention.
Figure 2:
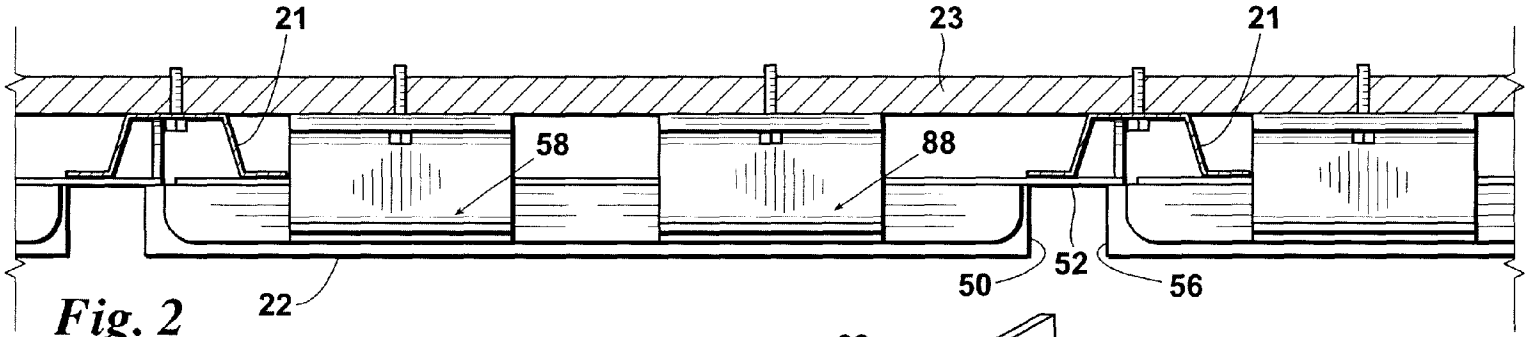
FIG. 2 is a top view of the panel system of FIG. 1 taken along lines 2-2 of FIG. 1.
Figure 8:
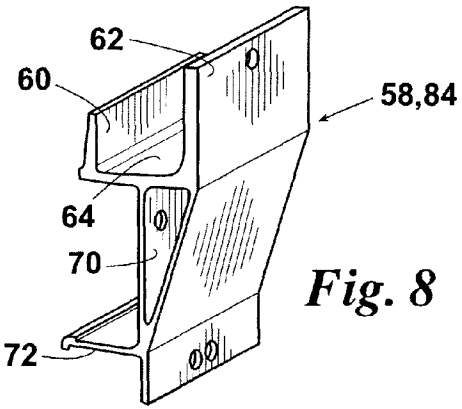
FIG. 8 is an enlarged perspective view of a top clip of the panel system of FIG. 1.
Figure 7:
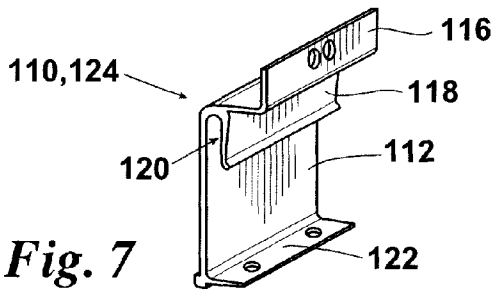
FIG. 7 is an enlarged perspective view of a bottom clip of the panel system of FIG. 1.
Figure 10:
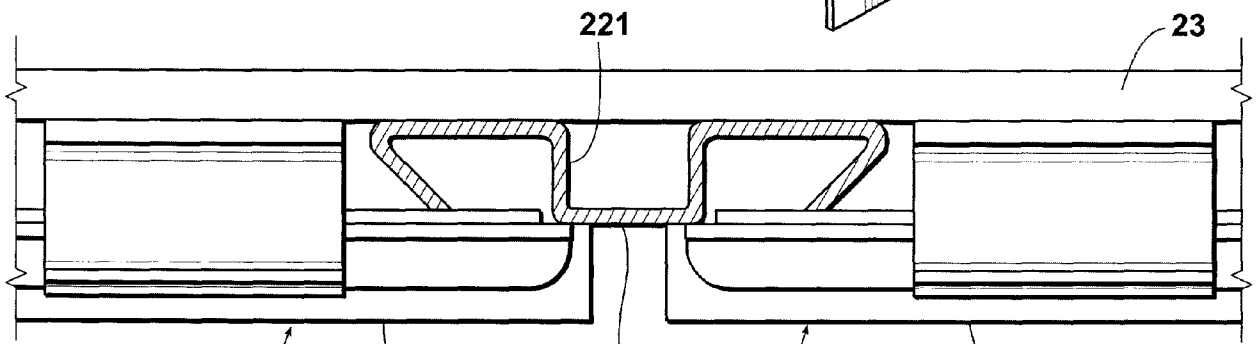
FIG. 10 is a top view of the panel system of FIG. 9.
Figure 3:
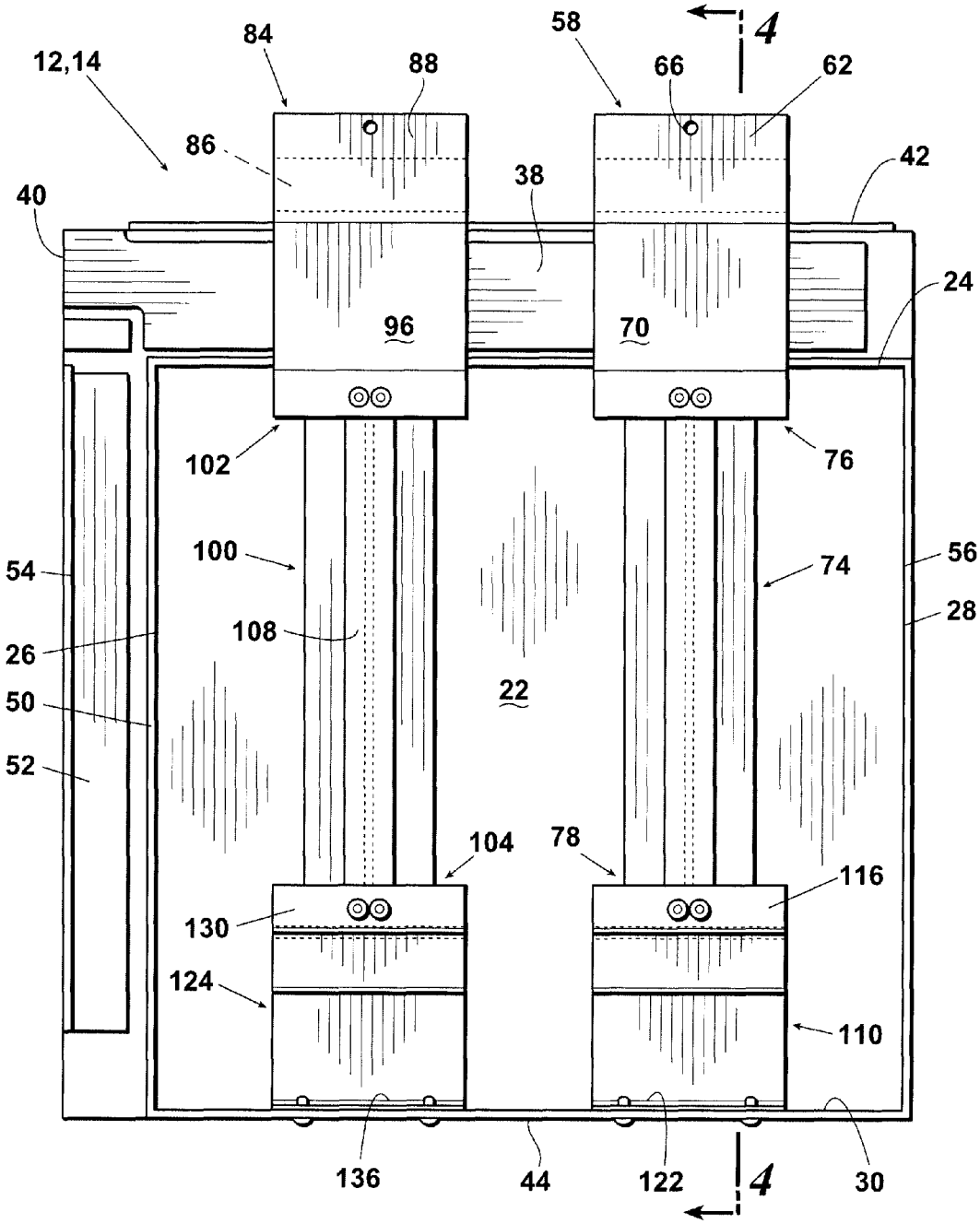
FIG. 3 is a rear elevation view of one of the panels of the panel system of FIG. 1.

A wall mounted panel system designated generally 10 comprises a plurality of panels 12. A plurality of panels 12, for example first panel 14, second panel 16, third panel 18, fourth panel 20. Hat channels 21 are affixed to a wall surface 23 behind panels 12. Hat channels 21 are located behind a joint gap formed by adjacent panels and functions as a vertical gutter for any water that may migrate behind the panels. First panel 14 includes a main vertical member 22 having a top edge 24, right edge 26, left edge 28, and bottom edge 30. Panels 12 are preferably constructed of a composite aluminum skin bonded to a polyethylene core. The aluminum skin material may be machined from one side to facilitate bending of the material, e.g., to create edges 24, 26, 28, and 30.

Top member 32 (FIGS. 4, 5) has an inside surface and an outside surface. Top member 32 and main vertical member 22 have an inside surface that defines a recess 36 (FIGS. 4-6) where members 22 and 32 join, i.e., wherein the metallic skin and a portion of the core material is removed to create a recess for receiving a protrusion of an upper bracket. Top member 32 extends rearwardly from top edge 24 of main vertical member 22. Top member 32 has an upper vertical flange member 38 that protrudes upwardly therefrom. Upper vertical flange member 38 has a right end 40 that extends a distance to the right of right edge 26 of main vertical member 22.

An uppermost horizontal member 42 (FIGS. 1, 3, 4, 6) extends forwardly from a top edge of upper vertical flange member 38. Uppermost horizontal member 42 preferably has a width equal to a width of main vertical member 22. Top member 32, vertical flange member 38, and uppermost horizontal member 42 form a channel or horizontal gutter that directs water horizontally.

Bottom member 44 has an outside surface and an inside surface. Bottom member 44 defines a first recess 46 and a second recess 48 machined on the inside surface, i.e., wherein the metallic skin and a portion of the core material is removed to create a recess for receiving a protrusion of a bottom bracket.

Right member 50 (FIGS. 1, 3) extends rearwardly away from right edge 26 of main vertical member 22. Right member 50 has a right vertical flange member 52 that protrudes therefrom to a distance equal to the distance of upper vertical flange member 38 extends to the right of right edge 26 of main vertical member 22. An upper end of right vertical flange member 38 is inserted behind the right end 40 of upper vertical flange member 38, thereby creating a shingle-like overlap to deter an influx of water behind panel system 10.

Right border flange member 54 is affixed to an outer edge of the right vertical flange member 52. Right border flange member 54 extends in a rearward direction from the right vertical flange member 52.

Left member 56 extends rearwardly from left edge 28 of main vertical member 22. A first upper bracket 58 has a forward upwardly extending member 60 and a rearward upwardly extending member 62 separated by upper horizontal member 64. Rearward upwardly extending member 62 defines a first mounting orifice 66. Forward upwardly extending member 60, rearward upwardly extending member 62, and an upper surface of upper horizontal member 64 define an upwardly facing channel 68. First upper bracket 58 further defines a lower downwardly extending member 70 and a lower horizontal member 72 wherein a lower surface of upper horizontal member 64 engages an upper surface of uppermost horizontal member 42. Lower horizontal member 72 engages a lower surface of top member 32 (see, e.g., FIG. 6).

First brace member 74 (FIG. 3) has a first end 76, a second end 78, base 80 (FIGS. 4, 5), and a top surface 82. Base 80 is in contact with a rear surface of main vertical member 22. The top surface 82 of first end 78 is affixed to the lower vertical downwardly extending member 70 of first upper bracket 58.

A second upper bracket 84 has a forward upwardly extending member 86 and a rearward upwardly extending member 88 separated by an upper horizontal member (not shown). Rearward upwardly extending member 88 defines second mounting orifice 92. Forward upwardly extending member 86, rearward upwardly extending member 88, and an upper surface of the upper horizontal member define an upwardly facing channel similar to upwardly facing channel 68 of first upper bracket 58. Second upper bracket 84 further defines a lower downwardly extending member 96 and a lower horizontal member similar to lower horizontal member 72 of first upper bracket 58. A lower surface of the upper horizontal member engages an upper surface of uppermost horizontal member 42. The lower horizontal member engages a lower surface of top member 32.

Second brace member 100 has a first end 102, a second end 104, a base, and a top surface 108. The base is in contact with a rear surface of main vertical member 22. Top surface 108 of second end 104 is affixed to lower downwardly extending member 96 of second upper bracket 84. First brace member 74 and second brace member 100 are preferably affixed to an inside of main vertical member 22 with a structural silicon or other adhesive. Brace members 74 and 100 function as stiffeners that distribute load to wall 23 rather than through panel 12, thereby allowing panel system 10 to meet high wind load standards.

Figure 4:
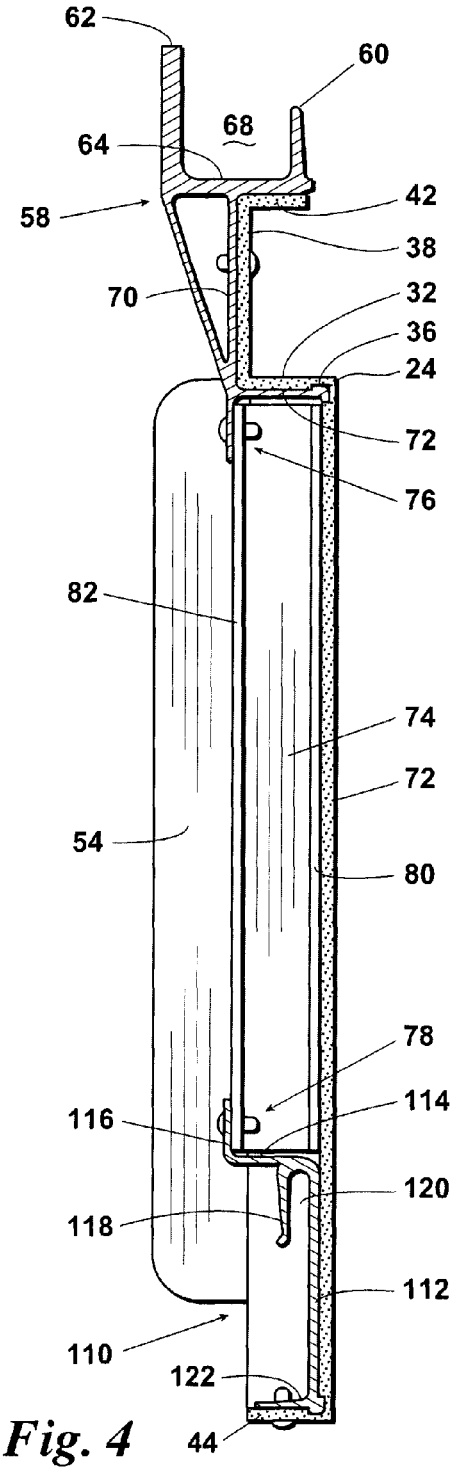
FIG. 4 is a side view of one of the panels of the panel system of FIG. 1, taken along lines 4-4 of FIG. 3.
Figure 5:
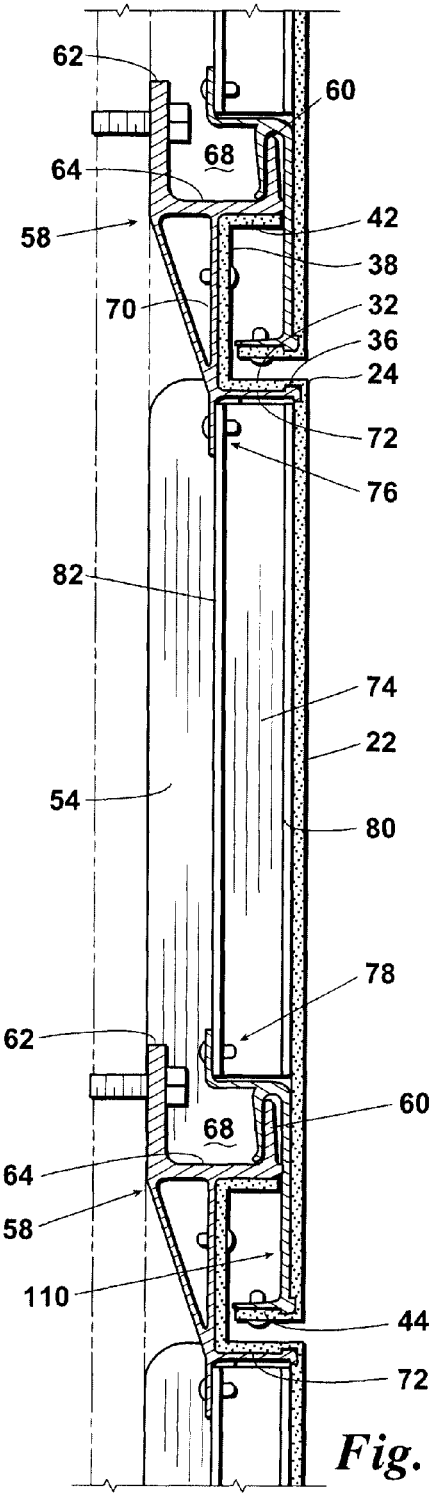
FIG. 5 is a side view of the panel of FIG. 4 shown assembled with other panels.
Figure 6:
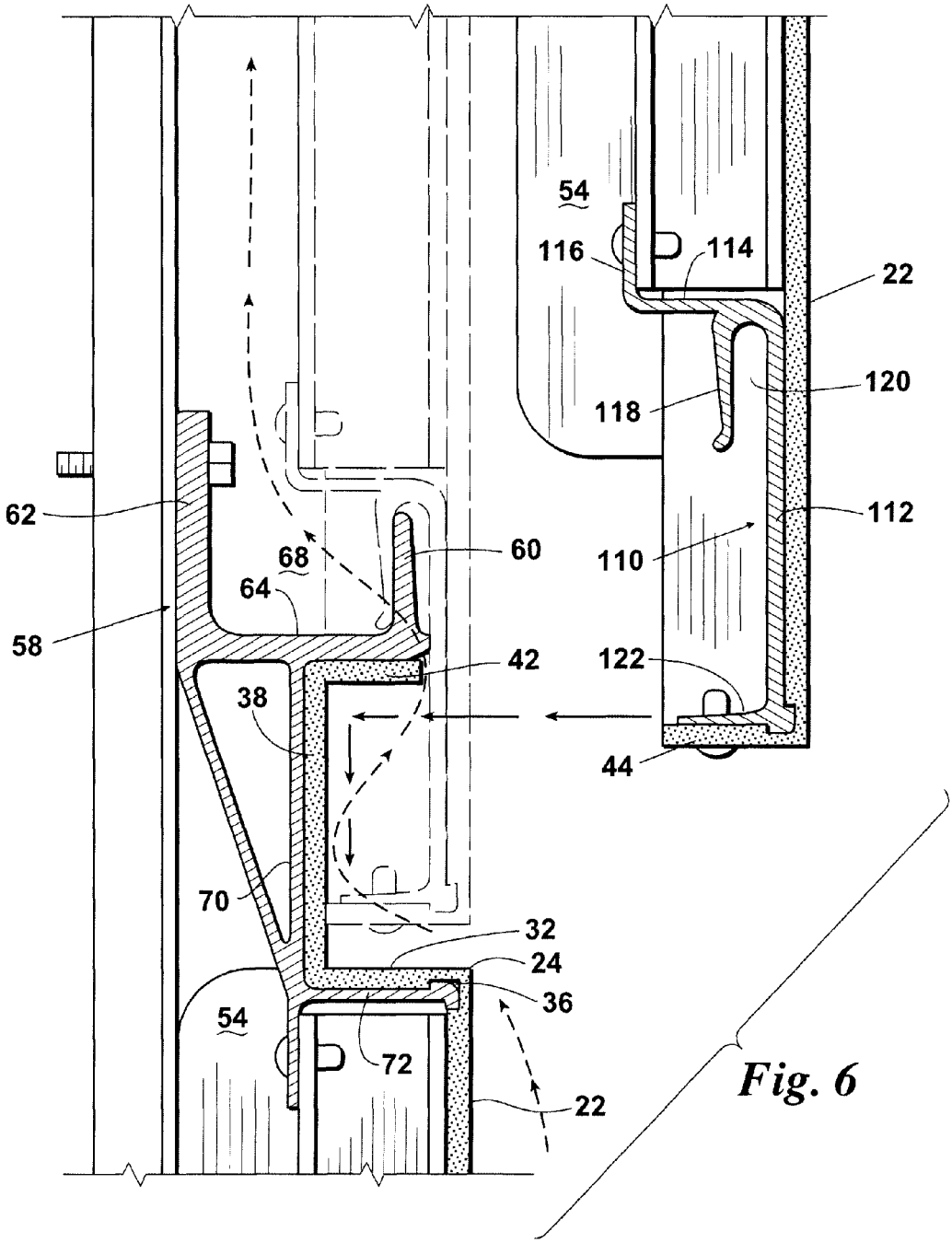
FIG. 6 is an enlarged view of a top of one panel and a bottom of a second panel of the panel system of FIG. 1 and showing the interlocking configuration of the first and second panels in partial phantom lines.
Figure 9:
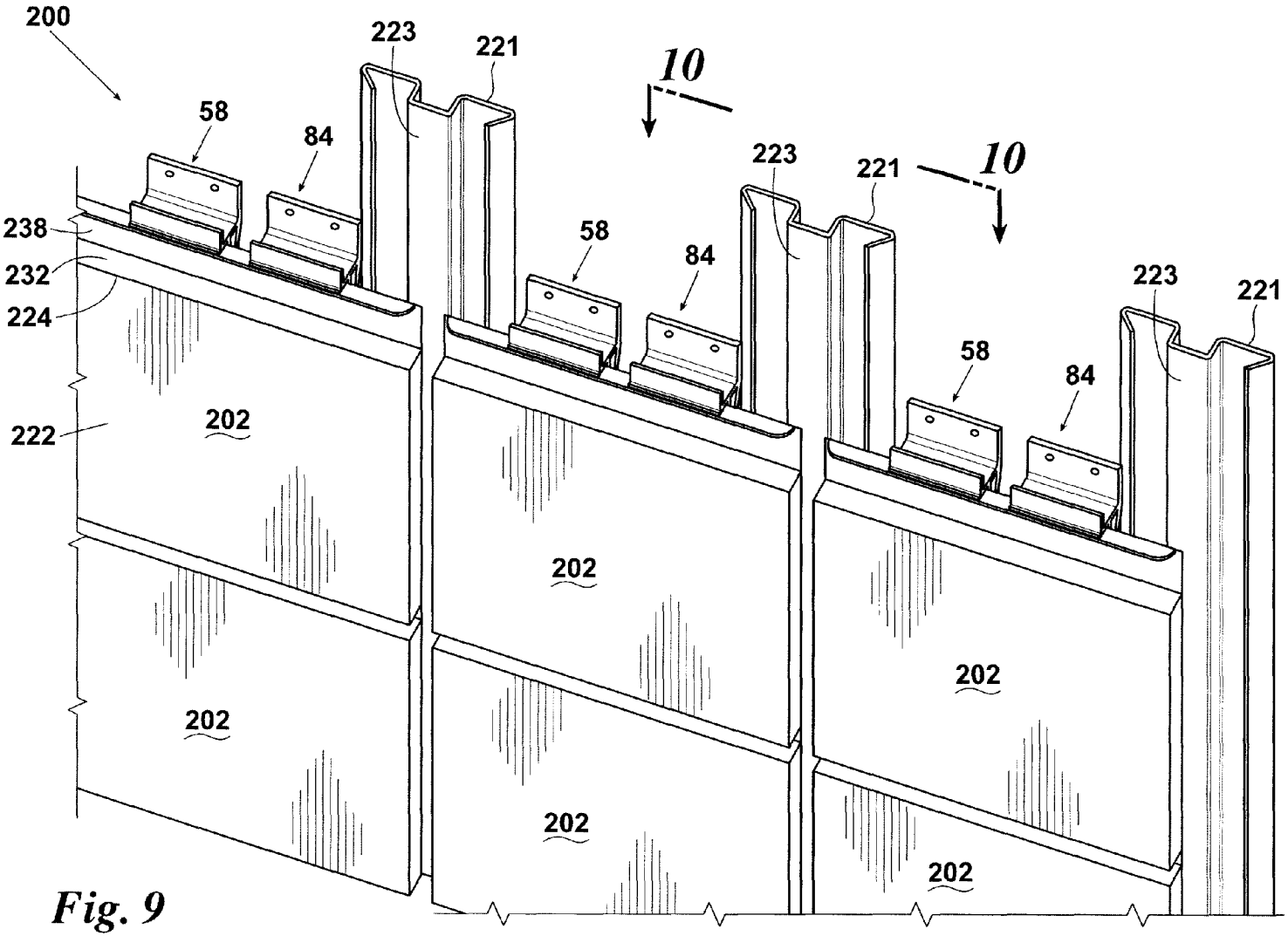
FIG. 9 is a perspective view of an alternate embodiment of the panel system.
Figure 11:
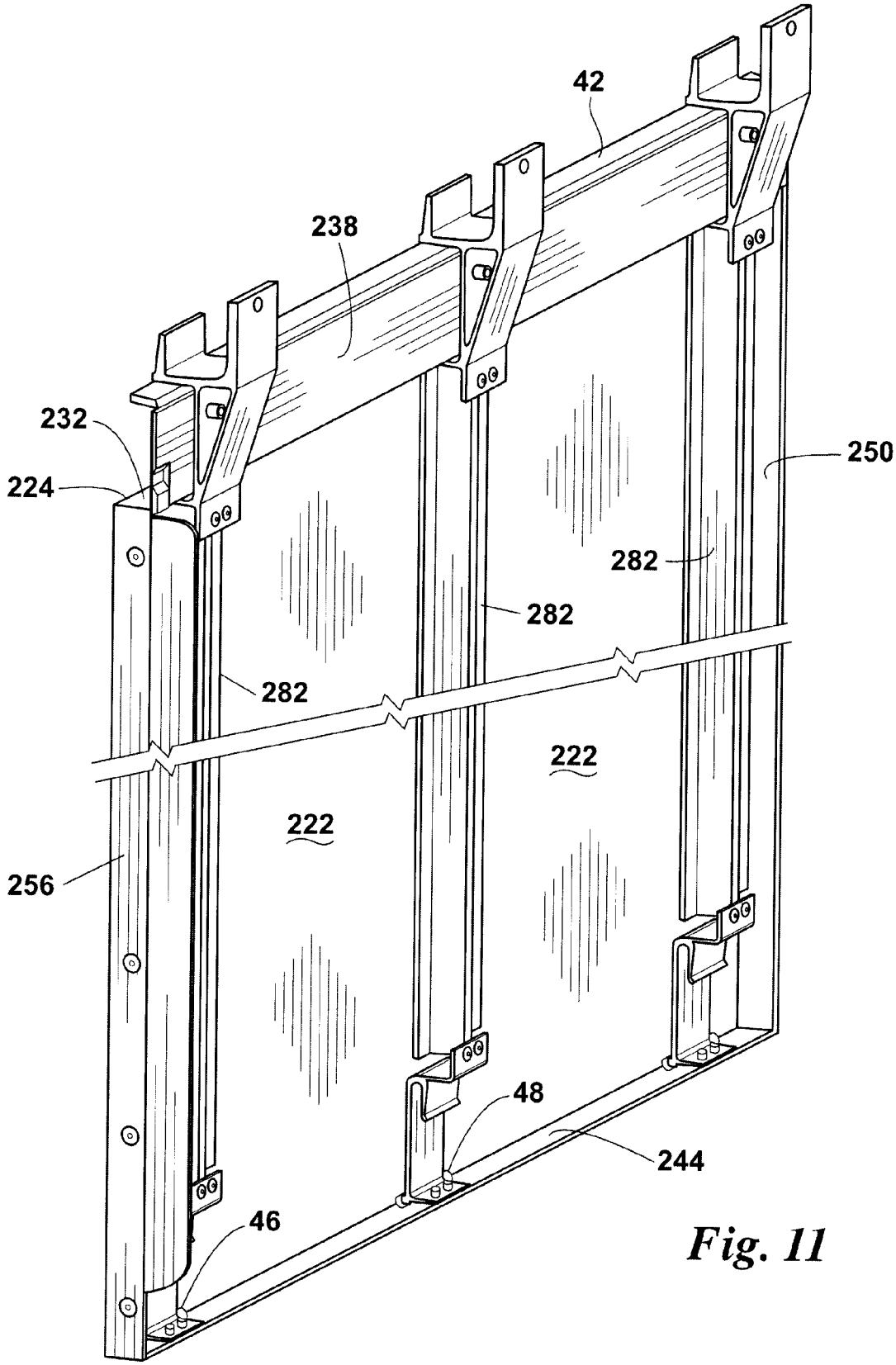
FIG. 11 is a rear perspective view of a panel interior of the panel system of FIG. 9.

Referring now primarily to FIGS. 4 and 6, first lower bracket 110 has a base surface 112 affixed to a rear surface of main vertical member 22. First lower bracket 110 further defines an upper horizontal member 114 and upper upwardly extending vertical member 116 that extends from a rearward edge of upward horizontal member 114. First lower bracket 110 additionally defines a downwardly extending vertical member 118 that defines a receiving space 120 between downwardly extending vertical member 118 and base surface 112. First lower bracket 110 further defines lower horizontal surface 122 for engaging an inside surface of bottom member 44.

Second end 78 of first brace member 74 contacts an upper surface of bottom member 44.

Second lower bracket 124 has a base surface affixed to the rear surface of main vertical member 22. Second lower bracket 124 further defines upper horizontal member and upwardly extending vertical member 130 that extends from a rearward edge of upper horizontal member 128. Second lower bracket 124 additionally defines downwardly extending vertical member that defines receiving space between the downwardly extending vertical member and base surface 126. Second lower bracket 124 further defines lower horizontal surface 136 for engaging inside surface of bottom member 44.

Second end 104 of second brace member 100 contacts an upper surface of bottom member 44.

Although first panel 12 was discussed above, it should be understood that second panel 14, third panel 16, and fourth panel 18 share similar components that will share the numerical designations of counterpart components from panel 12.

Wall mounted panel system 10 additionally includes second panel 16 that may be installed above first panel 14 (FIG. 1) by locating downwardly extending vertical member 118 of first lower bracket 110 of second panel 16 into upwardly facing channel 68 of first upper bracket 58 of first panel 14. Additionally, downwardly extending vertical member 132 of second lower bracket 124 of second panel 16 is located in upwardly facing channel 94 of second upper bracket 84 of first panel 14. The interface between upper brackets 58, 84 of first panel 14 and lower brackets 110, 124 of second panel 16 allow for relative movements between panels 14 and 16. Each of panels 12, 14, 16, and 18 are affixed to a wall surface at first mounting orifice 66 and second mounting orifice 92, thereby permitting three directions of expansion and contraction.

Wherein space 138 between first panel 14 and second panel 16 is occupied by upper vertical flange member 38 of second panel 16.

Additionally, third panel 18 may be installed adjacent to first panel 14. Wherein space 140 between first panel 14 and third panel 18 is occupied by right vertical flange member 52. The integrated upper flange member 38 and right vertical flange member 52 provide coverage between panels 12, i.e., form integral reveal strips, thereby ensuring consistency in color and a relation in components of panel system 10.

Referring now to FIGS. 9-12, shown is an alternate embodiment 200 of the panel system of the invention, which shares some components of the previously discussed system 10. System 200 utilizes panels 202 having a main vertical member 222. Panels 202 have a top member 232 having an inside surface and an outside surface. Top member 232 extends rearwardly from top edge 224 of main vertical member 222. Top member 232 has an upper vertical flange member 238 that protrudes upwardly therefrom. Bottom member 244, right member 250 and left member 256 extend rearwardly from main vertical member 222 (see FIG. 11).

Panels 202 are affixed to a wall surface 23 in the same manner as wall system 10, discussed above. Embodiment 200, however, utilizes a modified hat channel 221 that provides an integral reveal strip 223, thereby eliminating a need for panels 202 to have integral flange members between side by side adjacent panels. In this embodiment of the invention, upper vertical flange members 238 (FIG. 11) occupy the space in between above and below adjacent panels 202.

Three brace members 282 are shown affixed to a rear surface of main vertical member 222. However, greater than three or less than three brace members 282 may be utilized as conditions warrant.

The panel system of the invention is advantageous in that the system presents clean lines for an improved aesthetic appearance. The wall attachment methodology and interlocking brackets that allow relative movement between panels ensures that three-directional movement is facilitated to accommodate thermal expansion and other forces. The shingled jointery created by overlapping surfaces functions to minimize water penetration and to eliminate the necessity for gaskets and sealants between adjacent panels. The panel system of the invention eliminates a requirement for affixing a framework to a wall surface to receive panels, since each panel is affixed to the wall surface via upper brackets. As can be seen in FIG. 6, the interlocking panels of the invention facilitate air flow behind the panels to effect the drying of water that has migrated behind the panels.

* * *

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A wall mounted panel system comprising:

a first panel having an exterior surface and an interior surface:

a second panel having an exterior surface and an interior surface, said second panel adjacent to and below said first panel;

a first upper bracket affixed to said first panel;

a second upper bracket affixed to said second panel;

a first lower bracket affixed to said first panel;

a second lower bracket affixed to said second panel;

wherein said first upper bracket and said second upper bracket are affixed to the wall;

wherein said first lower bracket is movably engaged with said second upper bracket of said second panel;

wherein each of said first panel and said second panel have three directions of expansion and contraction since each of said first panel and said second panel is affixed to the wall with only said upper brackets;

wherein said first panel and said second panel are comprised of an aluminum composite material having an aluminum skin bonded to a core material; and said first upper bracket defines a protrusion;

said first panel comprises a top member, said top member defining a recess wherein a portion of said aluminum skin and said core material is removed to receive said protrusion from said first upper bracket.

2. A wall mounted panel system comprising:

a first panel having an exterior surface and an interior surface:

a second panel having an exterior surface and an interior surface, said second panel adjacent to and below said first panel;

a first upper bracket affixed to said first panel;

a second upper bracket affixed to said second panel;

a first lower bracket affixed to said first panel;

a second lower bracket affixed to said second panel;

wherein said first upper bracket and said second upper bracket are affixed to the wall;

wherein said first lower bracket is movably engaged with said second upper bracket of said second panel;

wherein each of said first panel and said second panel have three directions of expansion and contraction since each of said first panel and said second panel is affixed to the wall with only said upper brackets;

wherein said first panel and said second panel are comprised of an aluminum composite material having an aluminum skin bonded to a core material; and said first lower bracket defines a protrusion;

said first panel comprises a bottom member, said bottom member defining a recess wherein a portion of said core material is removed to receive said protrusion from said first lower bracket.

3. A wall mounted panel system comprising:

a first panel and a second panel, each having an upper edge, a lower edge, a right edge and a left edge, each of said first panel and said second panel affixed to the wall;

an upper flange member extending from said upper edge of each of said first panel and said second panel;

wherein said upper flange member of said second panel extends beneath said lower edge of said first panel, thereby forming a shingle type horizontal interface so that water will tend to flow over said first panel and said second panel rather than migrate behind said first panel and said second panel;

a first upper bracket affixed to an interior surface of said first panel;

a second upper bracket affixed to an interior surface of said second panel;

a first lower bracket affixed to said interior surface of said first panel;

a second lower bracket affixed to said interior surface of said second panel;

wherein said first lower bracket is movably engaged with said second upper bracket of said second panel;

wherein each of said first panel and said second panel have three directions of expansion and contraction since each of said first panel and said second panel is affixed to the wall with only said upper brackets.

4. A wall mounted panel system comprising:

a first panel and a second panel, each having an upper edge, a lower edge, a right edge and a left edge, each of said first panel and said second panel affixed to the wall;

an upper flange member extending from said upper edge of each of said first panel and said second panel;

wherein said upper flange member of said second panel extends beneath said lower edge of said first panel, thereby forming a shingle type horizontal interface so that water will tend to flow over said first panel and said second panel rather than migrate behind said first panel and said second panel;

wherein said first panel is comprised of an aluminum composite material having an aluminum skin bonded to a core material;

a first upper bracket affixed to an interior surface of said first panel;

wherein said first upper bracket defines a protrusion; and wherein said first panel comprises a top member, said top member defining a recess wherein a portion of said aluminum skin and said core material is removed to receive said protrusion from said first upper bracket.

5. A wall mounted panel system comprising:

a first panel and a second panel, each having an upper edge, a lower edge, a right edge and a left edge, each of said first panel and said second panel affixed to the wall;

an upper flange member extending from said upper edge of each of said first panel and said second panel;

wherein said upper flange member of said second panel extends beneath said lower edge of said first panel, thereby forming a shingle type horizontal interface so that water will tend to flow over said first panel and said second panel rather than migrate behind said first panel and said second panel;

wherein said first panel is comprised of an aluminum composite material having an aluminum skin bonded to a core material;

a first lower bracket affixed to an interior surface of said first panel;

wherein said first lower bracket defines a protrusion; and wherein said first panel comprises a bottom member, said bottom member defining a recess wherein a portion of said core material is removed to receive said protrusion from said first lower bracket.

6. A wall mounted panel system comprising:

a first panel having an exterior surface and an interior surface;

a first upper bracket affixed to said interior surface of said first panel;

a first lower bracket affixed to said interior surface of said first panel;

a first brace member having an upper end and a lower end, said upper end affixed to said first upper bracket and said lower end affixed to said first lower bracket, said first brace member in communication with said interior surface of said first panel;

wherein said first upper bracket is affixed to the wall;

wherein said first panel is comprised of an aluminum composite material having an aluminum skin bonded to a core material;

said first upper bracket defines a protrusion;

said first panel comprises a top member, said top member defining a recess wherein a portion of said aluminum skin and said core material is removed to receive said protrusion from said first upper bracket.

7. A wall mounted panel system comprising:

a first panel having an exterior surface and an interior surface;

a first upper bracket affixed to said interior surface of said first panel;

a first lower bracket affixed to said interior surface of said first panel;

a first brace member having an upper end and a lower end, said upper end affixed to said first upper bracket and said lower end affixed to said first lower bracket, said first brace member in communication with said interior surface of said first panel;

wherein said first upper bracket is affixed to the wall;

wherein said first panel is comprised of an aluminum composite material having an aluminum skin bonded to a core material;

said first lower bracket defines a protrusion;

said first panel comprises a bottom member, said bottom member defining a recess wherein a portion of said aluminum skin and core material is removed to receive said protrusion from said first lower bracket.

* * * * *